United States Patent [19]

Bonne et al.

[11] 4,090,663

[45] May 23, 1978

[54] FAN CONTROL FOR FORCED AIR TEMPERATURE CONDITIONING APPARATUS

[75] Inventors: Ulrich Bonne, Hopkins; James R. Tobias, Minneapolis, both of Minn.

[73] Assignee: Honeywell Inc., Minneapolis, Minn.

[21] Appl. No.: 772,795

[22] Filed: Feb. 28, 1977

[51] Int. Cl.[2] ..... F23N 3/08

[52] U.S. Cl. ..... 236/10; 236/DIG. 9; 236/91 F; 165/40

[58] Field of Search ..... 236/10, 11, DIG. 9, 236/91 F; 165/40

[56] References Cited

U.S. PATENT DOCUMENTS

| | | | |
|---|---|---|---|
| 2,329,813 | 9/1943 | Amsler | 236/91 F |
| 2,369,044 | 2/1945 | Hallinan | 236/10 |
| 2,557,027 | 6/1951 | Cross | 236/10 |
| 2,862,666 | 12/1958 | Kriechbaum | 236/11 X |
| 3,158,319 | 11/1964 | Nelson | 236/11 X |
| 3,472,452 | 10/1969 | Beeston | 236/11 X |

*Primary Examiner*—Clarence R. Gordon
*Attorney, Agent, or Firm*—Omund R. Dahle

[57] ABSTRACT

An improved fan controller for forced-air temperature conditioning apparatus for buildings, such as for example, forced warm air furnaces in which the fan turn-off is controlled as a function of the difference in temperature between the plenum temperature and the return air temperature.

6 Claims, 4 Drawing Figures

FAN CONTROL FOR FORCED AIR TEMPERATURE CONDITIONING APPARATUS

BACKGROUND OF THE INVENTION

This invention relates to a control system adapted to control an air circulation fan of a temperature conditioning apparatus as a function of the difference in temperature between the apparatus plenum temperature and the return air temperature. This may include heating and/or cooling apparatus, however; to simplify the description of the invention a forced air furnace is specifically described. In a specific embodiment then, this invention relates to a control system adapted for a forced warm air furnace air circulation fan or blower control and especially to maintaining furnace system efficiency during night setback operation. The setting of a thermostat to a lower temperature control point during the night (i.e. night setback) saves fuel because it reduces the building load imposed on the heating system. The resulting efficiency of forced warm air furnace systems may be lowered considerably, however, because of the relationship between the fixed steady state plenum temperature rise and make-break circulating fan switch temperature settings on one hand, and the variable room air temperatures (combustion and return air temperatures) on the other hand.

The improved control system to avoid deterioration of furnace system efficiency during night setback is to reduce the air circulating fan turn-off setpoint by substantially the same amount in degrees that the room temperature is dropped, and in the preferred embodiment shown, this is by adding a return air temperature sensor in addition to the plenum temperature sensor and feeding both signals to a circuit which responds to the difference in the two signals.

DESCRIPTION OF THE PREFERRED EMBODIMENT

Figure 1:
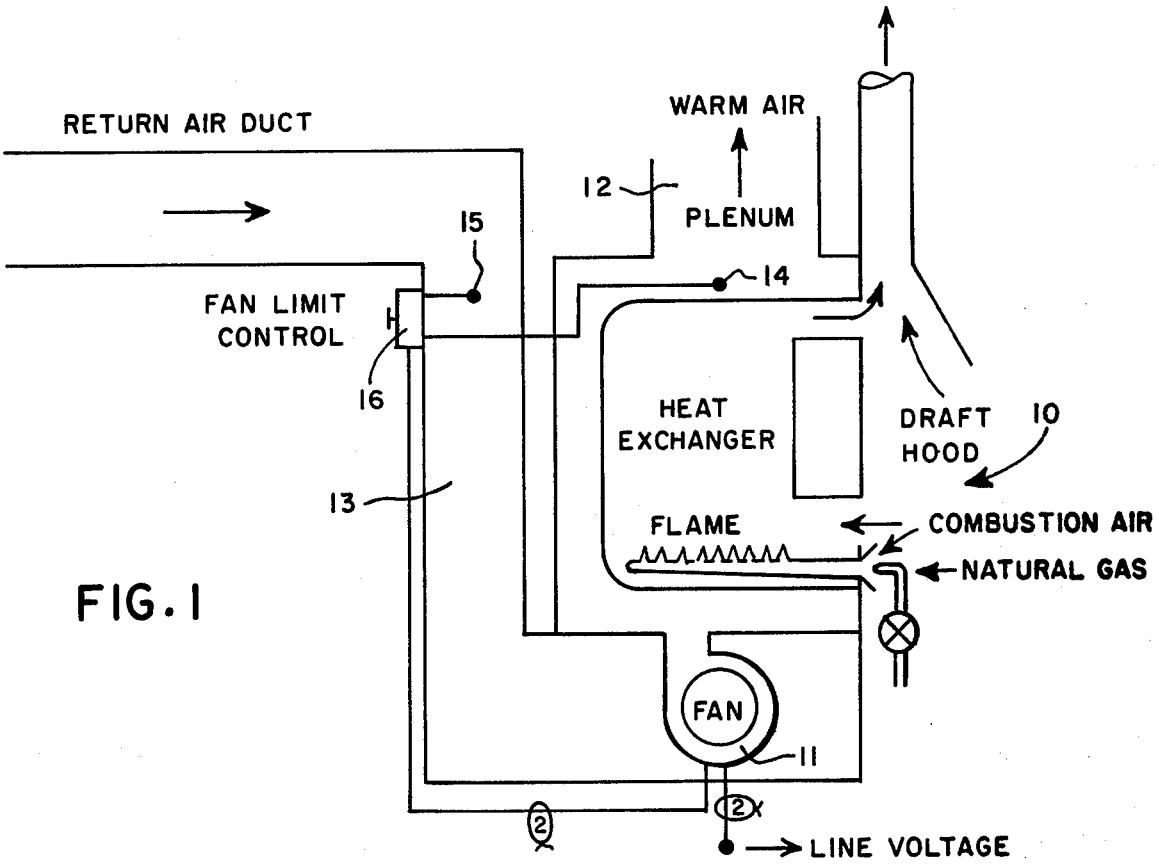
FIG. 1 is a schematic view of a forced warm air furnace equipped with the improved difference temperature fan control.

In FIG. 1 the temperature conditioning apparatus, shown as a gas-fired, forced warm-air furnace, is generally shown at 10, having a fan 11 to circulate the warm air from the furnace plenum 12 throughout the heated space. The return air duct or passage 13 brings room return air back to the fan. In the plenum 12 or furnace discharge air stream there is a first temperature sensor 14, such as for example an NTC thermistor, and in the return air duct 13 there is a second temperature sensor 15 which may be of the same type. Both sensors 14 and 15 are connected to a differential fan limit control 16. The fan limit control 16 controls the energization of the fan 11. Although thermistors are shown as sensors, the sensors may also be thermocouples activating a circuit. The sensors may also be non-electrical types such as bulb-and-tube or bimetal.

Figure 2:
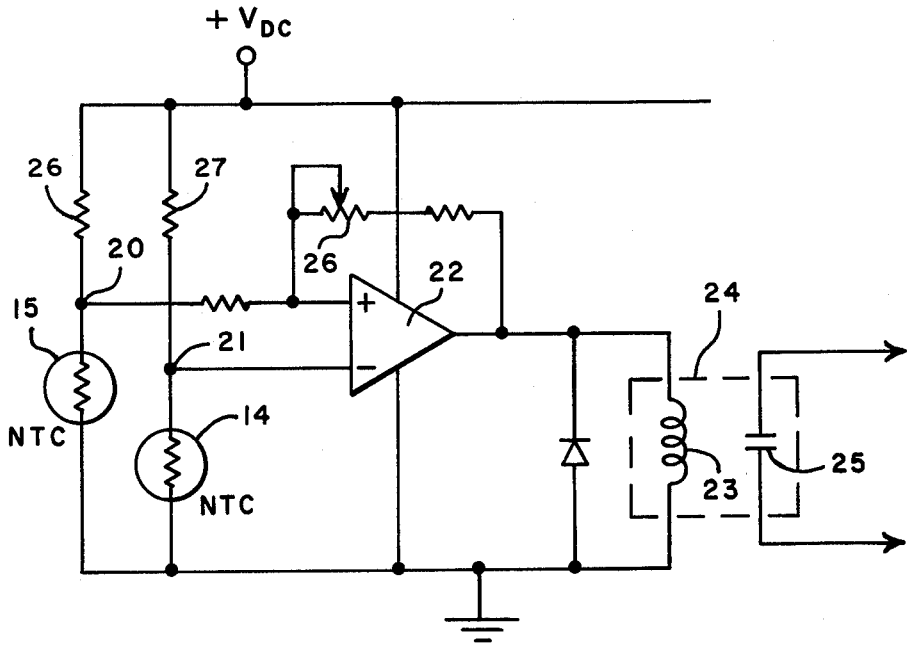
FIG. 2 shows a portion of FIG. 1 in greater detail.

In FIG. 2 the difference fan control 16 and the sensors are shown in more detail and the NTC sensors 14 and 15 are shown in a resistive bridge arrangement, the outputs 20 and 21 of the bridge being connected to the positive and negative inputs of an operational amplifier 22, such as a Fairchild$\mu$A798. Positive feedback is provided around the amplifier to make the amplifier output switch. The switching output of op. amp. 22 is connected in controlling relation to a relay 24 at winding 23, which relay switches the line voltage for fan 11 by means of the relay contacts 25. The resistive feedback as shown includes a differential adjustment potentiometer 26 as it may be desirable to have the amplifier pull-in at a signal level representing about 45° F difference at the sensors and drop-out at a lesser signal level representing about 20° F difference at the two sensors. The pot. 26 provides for adjusting this hysteresis between pull-in and drop-out.

In operation, this improved differential fan limit control 16 aids in maintaining the furnace system efficiency during night setback operation by reducing the fan break setpoint by the same number of degrees that the room temperature is dropped. For example, assume a day room temperature setpoint of 72° F and that at a temperature difference of 18° F between return air and plenum air the amplifier output drops and the relay drops out. The fan break thus occurs at a plenum temperature of 90° F. As the night setback drops the room temperature by 10° to 62° F let us say, a temperature difference of 18° still drops out the relay and the fan break is thus also reduced by 10° F to 80° F. This extends the fan operating time after flame-off to recover the residual heat still in the heat exchanger and helps to maintain the system efficiency.

Figure 3:
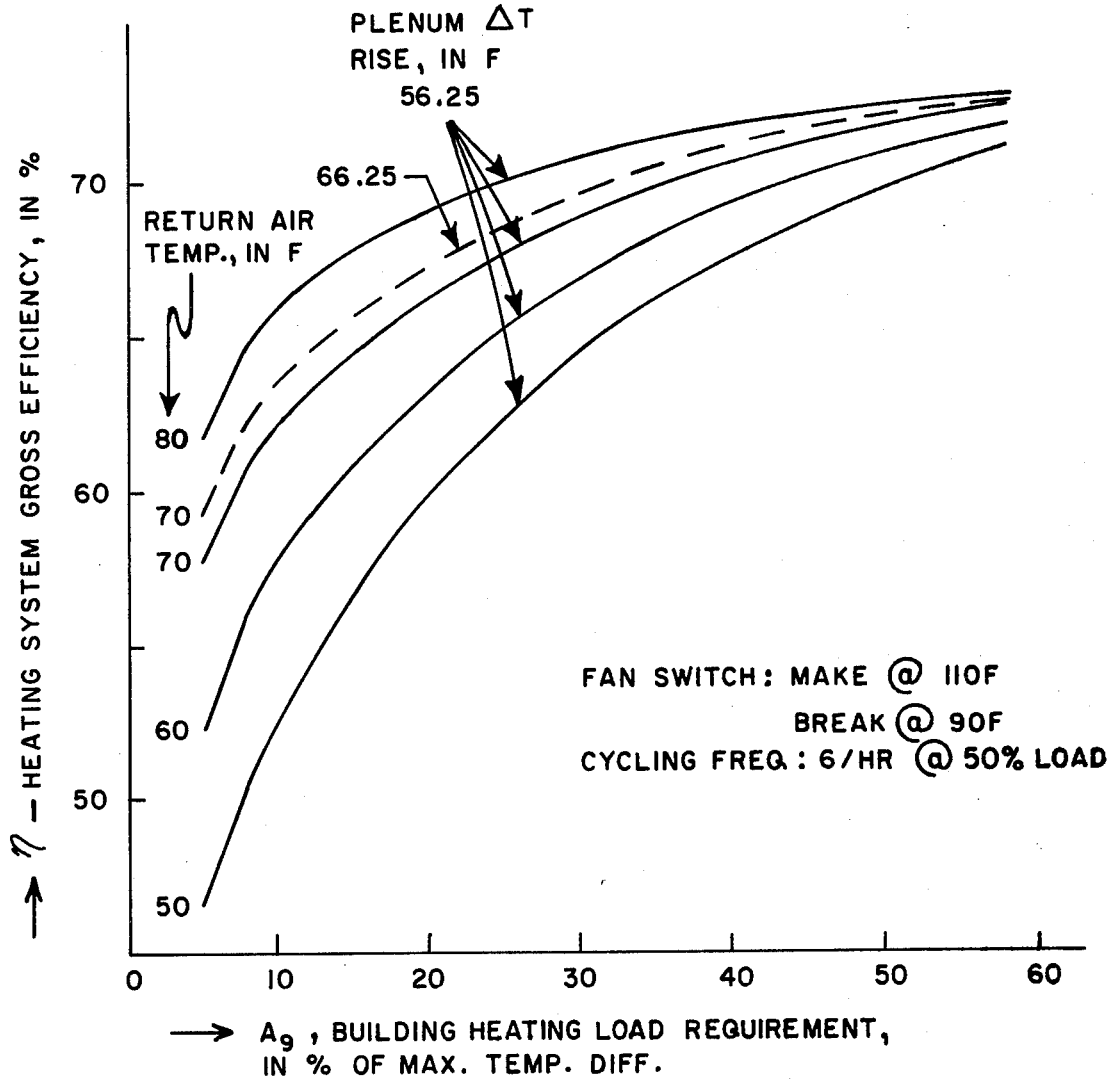
FIGS. 3 and 4 are graphical and show the calculated change in furnace system efficiency vs. furnace load (FIG. 3) and building load (FIG. 4).

FIG. 3 is a graphical representation illustrative of the problem existing in a conventional system. The figure plots gas-fired forced warm air furnace system efficiency vs building load, for various return air temperatures.

Figure 4:
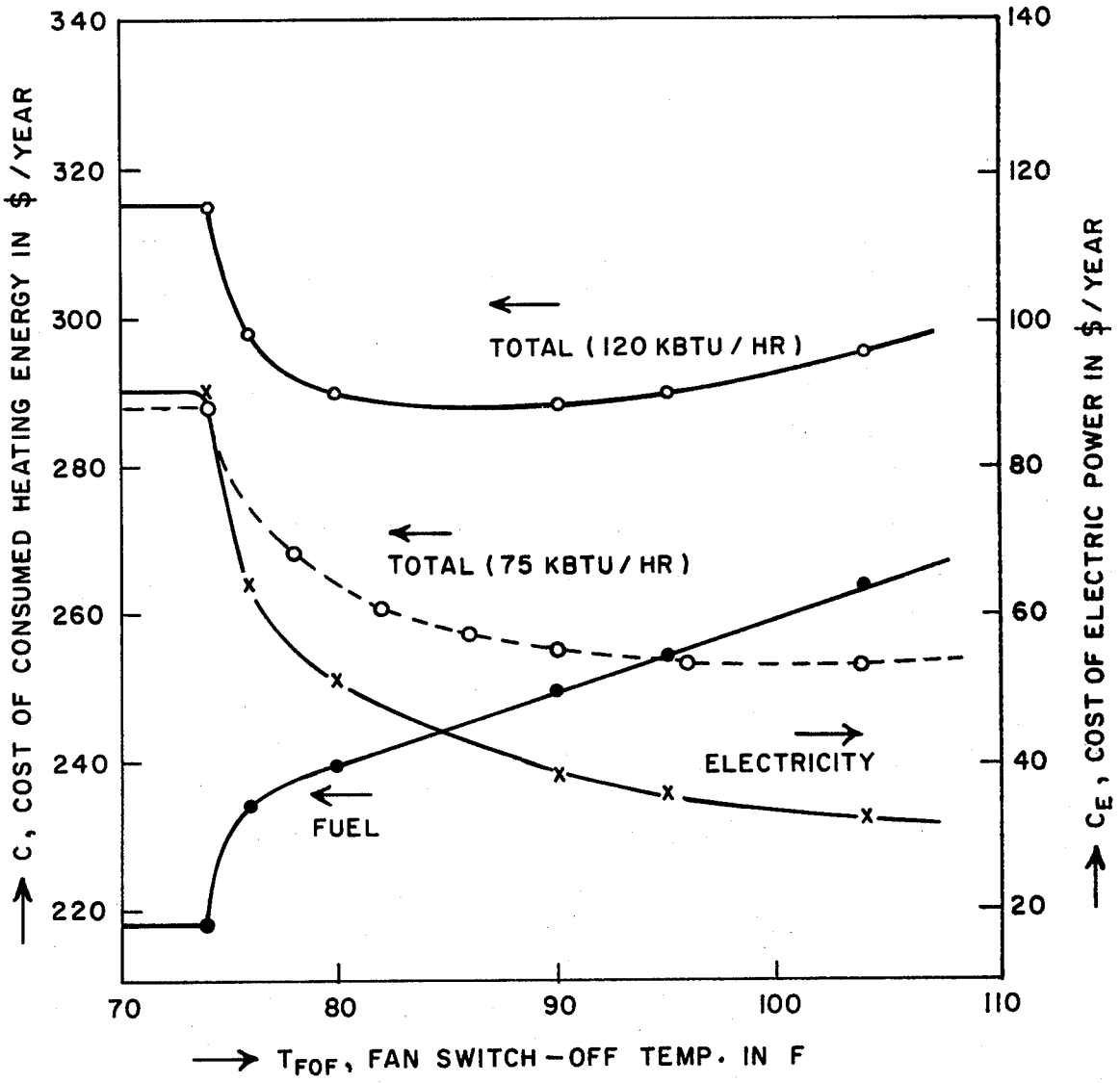

FIG. 4 shows graphically the seasonal operating cost (fuel plus electricity) of a typical gas-fired forced warm air furnace as a function of the circulating fan switch-off or breakpoint temperature setting in degrees F. The data was based on a location in Minneapolis with average Minnesota weather conditions. Other parameters include input: 120 kBTU/hr + 1 kBTU/hr pilot; system balance point; −90° F; design point −20° F; cooling time constant; 2.29 minutes (fan on), 8.10 minutes (fan off); room temp. 70° F; plenum temp. rise 80° F and costs: 1.5$/MBTU, 2.8¢/KWHR.

In Table 1 there is a computer simulation of a gas-fired forced warm air furnace system under various operating conditions. The specific furnace located in a St. Louis, Missouri house had a rating at 80 kBTU/hr + 1 kBTU/hr pilot for input, and this corresponded to a 73% overcapacity compared with the building load of 490 BTU/(hf). The listed "10° F setback" periods in the Table are for a complete heating season. The average local fuel savings of runs 2, 5 and 8 of 33.4% obtained with a digital simulation program compare to the seasonal 24.1% reduction in building load with a daily 8 hour (10 p.m. - 6 a.m.) setback of 10° F for the same heating season, obtained with an analog program.

Runs 1, 4 and 7 are reference runs with no setback. In run 1 the pilot is on all year, in runs 4 and 7 the pilot is off in the summer. In runs 1 and 7 the fan switch break temperature is 90° F and in run 4 it is 100° F. Runs 2, 5 and 8 are related to runs 1, 4 and 7 respectively but include a 10° F setback with fixed fan switch. Runs 3, 6 and 9 are also related to the runs 2, 5 and 8 but include a 10° F setback and also the differential fan switch of this invention.

The invention has been described in terms of electrical sensors such as thermistors. If the temperature sensor means are thermocouples instead, the thermocouples replace the circuit position shown for the thermistors in FIG. 2 and the resistors 26 and 27 are not needed as the positive $V_{DC}$ resistive paths through 26 and 27 are not needed. If the temperature sensor means are non-electrical types such as bulb-and-tube or bimetal devices they are set to operate a microswitch at a given temperature difference. An example of such a bulb-and-tube differential thermostat is the Honeywell Inc. Model L643A Differential Thermostat. A differential thermostat of this type is another embodiment of elements 14, 15 and 16 of FIG. 1 and replaces the thermistors, op. amp., and relay shown in FIG. 2.

TABLE I

| Simulation # Description | Fan Switch Make F | Fan Switch Break F | Room Temp. F | Plenum Steady State Temp. F | Plenum Steady State Rise | Local Fuel Efficiency % | Fuel $10^6$ BTU/yr | Operating Cost $/yr | Savings/ Previous Run % Fuel | Savings/ Previous Run % $ |
|---|---|---|---|---|---|---|---|---|---|---|
| 1 Ref., Pilot on all year | 110 | 90 | 68 | 133 | 65 | 58.56 | 102.93 | 181.88 | — | — |
| 2 10F setback fixed fan sw. | 110 | 90 | 58 | 123 | 65 | 51.11 | 69.95 | 119.47 | 32.05 | 34.32 |
| 3 10f setback diff. fan sw. | 42F Diff.* | 22F Diff. | 58 | 123 | 65 | 53.46 | 66.48 | 117.31 | 4.96 | 1.80 |
| 4 Ref. Pilot off in summer | 110 | 100 | 68 | 133 | 65 | 59.61 | 104.14 | 177.90 | — | — |
| 5 10F setback fixed fan sw. | 110 | 100 | 58 | 123 | 65 | 55.07 | 68.94 | 114.65 | 33.80 | 35.55 |
| 6 10F setback diff. fan sw. | 42F Diff. | 32F Diff. | 58 | 123 | 65 | 57.69 | 65.34 | 111.17 | 5.72 | 3.04 |
| 7 Ref. Pilot off in summer | 110 | 90 | 68 | 133 | 65 | 61.82 | 99.58 | 175.85 | — | — |
| 8 10F setback fixed fan sw. | 110 | 90 | 58 | 123 | 65 | 57.69 | 65.34 | 111.17 | 34.38 | 36.78 |
| 9 10F set back diff. fan sw. | 42F Diff. | 22F Diff. | 58 | 123 | 65 | 60.39 | 61.87 | 109.02 | 5.30 | 1.94 |

*Difference between return air and plenum air temperatures

The embodiments of the invention in which an exclusive property or right is claimed are defined as follows:

1. A control system adapted for controlling an air circulating fan in a forced-air temperature conditioning apparatus which apparatus has a plenum from which the temperature conditioned circulating air is distributed to the space being temperature conditioned and which has a return air passage from the space to said air circulating fan, the control system comprising:

first thermally responsive sensor means adapted to be mounted in a position so that it will be responsive to the temperature in a plenum of a temperature conditioning apparatus for providing a first signal which is a function of the temperature sensed;

second thermally responsive sensor means adapted to be mounted in a position so that it will be responsive to the temperature in a return air passage of the apparatus for providing a second signal which is a function of the second temperature sensed; and, difference temperature switching means, said switching means having switching terminals adapted to be connected in controlling relation to the air circulating fan, means connecting said first and second sensor means to said difference temperature switching means to be responsive to a predetermined difference in temperature sensed by said first and second sensor means, said switching means being operated only by the difference between said first and second signal such that when the difference between the signals reaches a first predetermined level the fan is turned on and when the difference drops to a second predetermined level the fan is turned off.

2. The control system according to claim 1, wherein the first and second sensor means are thermistors and provide first and second electrical signals.

3. The control system according to claim 1, wherein the sensor means are temperature responsive resistors connected in a resistive bridge circuit.

4. The control system according to claim 1 wherein the difference temperature switching means further includes a difference amplifier responsive to the difference between said first and second signal.

5. The control system according to claim 4 wherein the difference temperature switching means further includes a relay connected to the output of the difference amplifier, the relay including said switching terminals.

6. A method of controlling an air circulating fan in a forced-air temperature conditioning apparatus which apparatus has a plenum from which the temperature conditioned circulating air is distributed to the space being temperature conditioned and which has a return air passage from the space to said air circulating fan, the method comprising:

(a) providing first and second temperature responsive sensing means;

(b) sensing the temperature in a plenum of a temperature conditioning apparatus and providing a first signal which is a function of the temperature sensed;

(c) sensing the temperature in a return air passage of the apparatus and providing a second signal which is a function of the second temperature sensed;

(d) providing difference temperature switching means which are operated only by the difference between said first and second signals;

(e) comparing the first signal with the second signal to produce a difference signal; and, (f) changing the operation of the air circulating fan as a function of the difference between said first and second signal.

* * * * *